United States Patent [19]

Darbenzio

[11] Patent Number: 4,706,583

[45] Date of Patent: Nov. 17, 1987

[54] TEMPLATE FOR EMBROIDERY MACHINE

[76] Inventor: Anthony Darbenzio, R.D. 1, Box 112, Old State Rd., Falls, Pa. 18615

[21] Appl. No.: 891,448

[22] Filed: Jul. 29, 1986

[51] Int. Cl.[4] ..... D05C 7/04

[52] U.S. Cl. ..... 112/103

[58] Field of Search ..... 112/103, 102, 86, 88, 112/98

[56] References Cited

U.S. PATENT DOCUMENTS

| | | | |
|---|---|---|---|
| 2,091,727 | 8/1937 | Bohmann et al. | 112/102 |
| 2,896,562 | 7/1959 | Scheibel | 112/103 |
| 3,208,414 | 9/1965 | Reeber et al. | 112/2 |
| 3,595,188 | 7/1971 | Schmedding et al. | 112/221 |
| 3,664,288 | 5/1972 | Von Boden et al. | 112/103 |
| 4,208,975 | 6/1980 | Teetz | 112/86 |
| 4,357,885 | 11/1982 | Stockton | 112/103 |
| 4,386,572 | 6/1983 | Slomma | 112/98 |
| 4,433,632 | 2/1984 | Becka et al. | 112/121 |
| 4,444,133 | 4/1984 | Bolldorf et al. | 112/103 |

*Primary Examiner*—Ronald Feldbaum

*Attorney, Agent, or Firm*—Caesar, Rivise, Bernstein, Cohen & Pokotilow, Ltd.

[57] ABSTRACT

Templates for use with embroidering machines for embroiding material held within an embroidery hoop. The embroidery machine includes at least one working head and a platform located thereunder. The template is arranged to be disposed on the platform to hold a pair of embroidery hoops beside each other so that one of the hoops in the template is located under the working head while the other of the hoops is located laterally, whereupon material located in the hoop under the head can be embroidered while the other hoop can either be unloaded or loaded with material. The template is a generally planar panel which is arranged to be moved across the platform either alone or in combination with similar templates, in the case of use with a multihead embroidery machine, by a frame. Each template includes a pair of aligned openings, each configured to releasably hold an embroidery hoop with material therein. Releasable securement means are also provided to secure the templates to the frame means. And each template also includes an elastic strap to serve to hold down any overhanging material on the template.

15 Claims, 4 Drawing Figures

TEMPLATE FOR EMBROIDERY MACHINE

BACKGROUND OF THE INVENTION

This invention relates generally to devices for holding fabric to be embroidered by machine and more particularly to devices for holding at least a pair of embroidery hoops to enable the material in one hoop to be embroidered while the material in the other hoop is loaded or unloaded.

Various embroidery or sewing machines have been disclosed in the patent literature and many are commercial avialable for effecting simultaneous sewing or embroidery of fabric or material held within respective work holders, such as embroidery hoops, located under respective sewing or embroidery heads of the machine. Examples of patents disclosing multi-head embroidery or sewing machines are the following: U.S. Pat. Nos. 2,091,727 (Bohmann et al.), 3,595,188 (Schmedding et al.), 3,664,288 (Von Boden et al.), 4,357,885 (Stockton), 4,386,572 (Slomma), and 4,444,133 (Bolldorf et al.).

One typical commercially available multi-head embroidery machine is sold by Tokai Industrial Sewing Machine Co., Ltd., of Japan, under the designation Tajima, Model No. TMEF-612. That machine basically comprises twelve embroidery heads which are located in a side-by-side array. Each head includes several needles for sewing various different threads through a desired patch or fabric. Each patch or fabric is held in a respective embrodiery hoop disposed under a respective head of the machine. Each hoop is in turn held within a respective work holder, commonly referred to as a template.

While the above arrangement is suitable for its intended purposes it leaves much to be desired from the standpoint of efficiency of operation. In this regard when all of the patches which had been simultaneously embroidered are completed the multihead machine had to be stopped, all of the templates moved out from under the respective embroidery heads, the hoops containing the completed patches removed from the templates, new hoops including patches to be embroidered inserted into the templates and placed on the machine's platform so that the hoops are located under the working heads, and then the machine restarted. Obviously, this operation is wasteful of substantial time, thus reducing the output of the machine.

Some devices have been disclosed for effecting movement of the workpiece to be sewn or embroidered to the head of a sewing or embrodering machine. Examples of such patents are as follows: U.S. Pat. Nos. 3,208,414 (Reeber et al.), 4,208,975 (Teetz), and 4,433,632 (Becka et al.).

Notwithstanding the above, a need still exists for a simple device for enabling the embroidery (or sewing) of material by a working head of an embroidery (or sewing) machine while at the same time another piece of material is loaded or unloaded.

OBJECTS OF THE INVENTION

Accordingly, it is a general object of the instant invention to provide a device which overcomes the disadvantages of the prior art.

It is a further object of the instant invention to provide a template for holding a pair of embroidery hoops to enable material in one hoop to be embroidered while material in another hoop is either loaded or unloaded.

It is a further object of the instant invention to provide a dual hoop holding template which is simple in construcion and low in cost.

It is still a further object of the instant invention to provide a dual hoop holding template which can be utilized with other similarly constructed templates for use in a multihead embroidering or sewing machine.

SUMMARY OF THE INVENTION

These and other objects of the invention are achieved by providing a template for use with an embroidering machine for embroidering material held within an embroidery hoop. The machine includes a working head and a platform located thereunder. The template is arranged to be disposed on the platform of the machine to hold a pair of embroidery hoops beside each other so that a first one of the hoops can be located under the working head while the second one of the hoops is located laterally thereof, whereupon the working head can embroider material held in the first hoop while the second hoop can be unloaded or loaded with material. The template is arranged to be moved across the platform so that the second hoop can be located under the working head while the first hoop is located laterally thereof. The template basically comprises a generally planar panel having a pair of aligned openings. Each of the openings is configured to releasably hold an embroidery hoop with material to be embroidered therein.

BRIEF DESCRIPTION OF THE DRAWING

Other objects and many of the attendant advantages of the instant invention will be readily appreciated when the same becomes better understood by reference to the following detailed description when considered in connection with the accompanying drawing wherein.

DESCRIPTION OF THE PREFERRED EMBODIMENT

Figure 1:
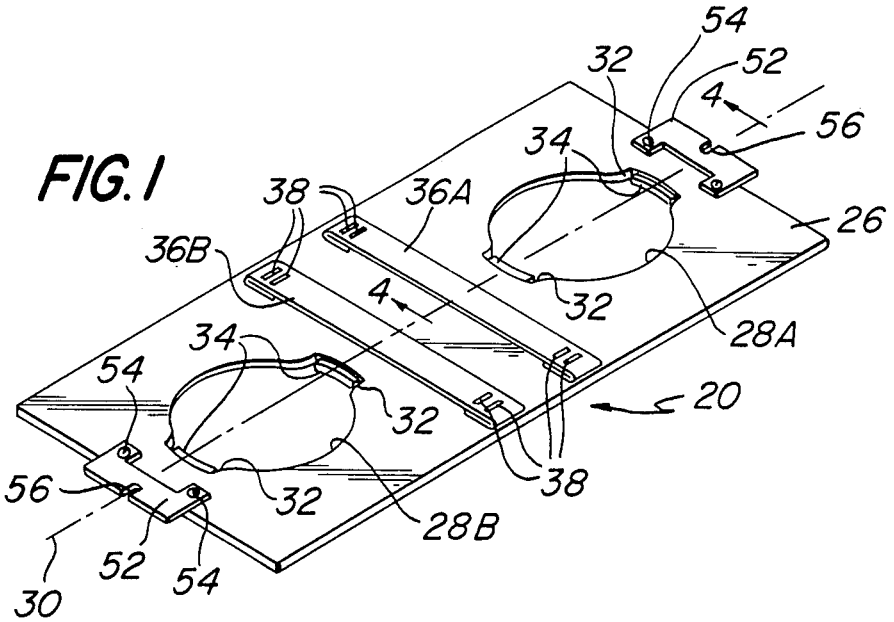
FIG. 1 is a perspective view of a dual hoop holding template constructed in accordance with the subject invention.

Referring now in greater detail to the various figures of the drawing wherein like reference characters refer to like parts, there is shown generally at 20 in FIG. 1 a template constructed in accordance with this invention and arranged for holding two conventional embroidery hoops 22 (FIG. 2) therein.

Figure 2:
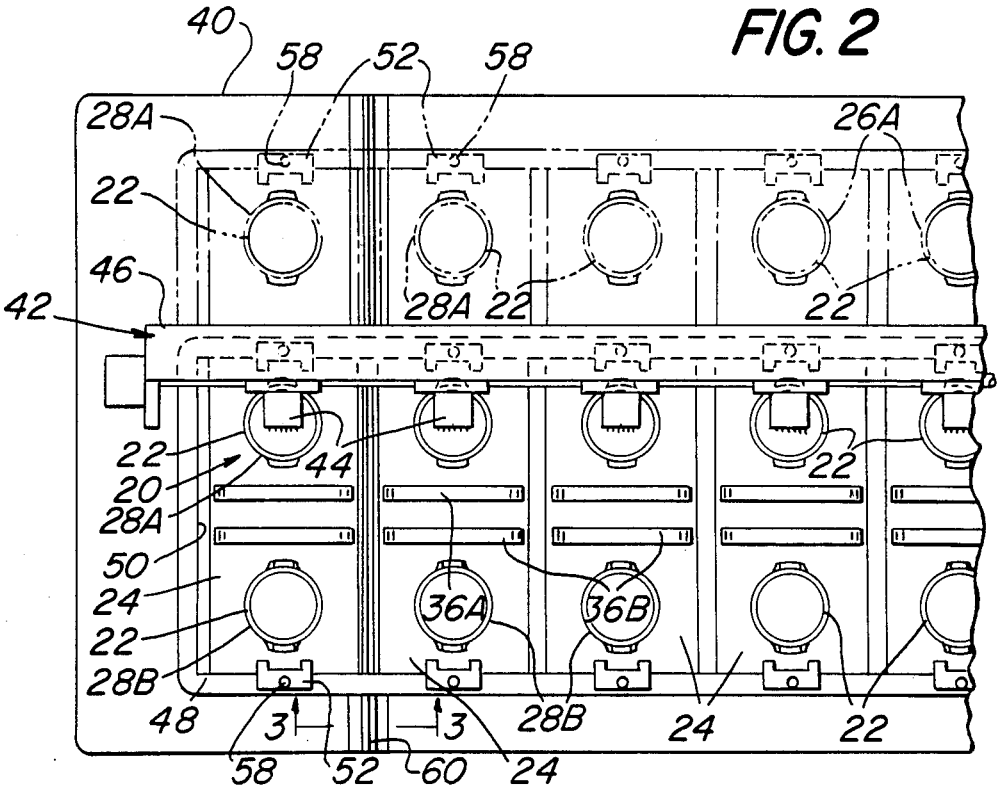
FIG. 2 is a top elevational view of a conventional multihead embroidering machine utilizing plural templates like that shown in FIG. 1.
Figure 4:
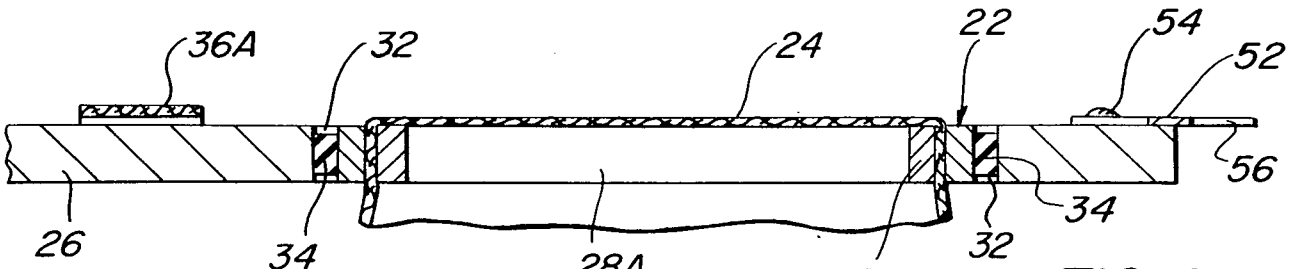
FIG. 4 is an enlarged sectional view taken along line 4—4 of FIG. 1.

As can be seen in FIGS. 2 and 4 each hoop 22 is of conventional construction including an inner ring 22A and an outer ring 22B for holding a portion of material or fabric tautly therebetween. Each hoop also includes adjustment means (not shown) for facilitating the placement and holding of the material 24 in the rings.

The template 20 basically comprises a thin, generally rectangular planar panel 26 having two openings 28A and 28B therein. The openings are aligned laterally along a longitudinal axis 30 with approximately 11.75 inches spacing between their centers. Each opening is of circular shape and of suitable size, e.g., approximately 5 inches in diameter, to closely accomodate a respective hoop 22 therein. In addition, each opening includes a pair of diametrically opposed recesses 32 centered on axis 30. Each recess is arranged to accomodate the hoop's adjustment means (not shown). Also disposed within each recess is a resilient, e.g., foam rubber, bumper 34 which acts to grip or hold the hoop in place within the opening as shown in FIG. 4. Thus, when a hoop 22 is held within an opening of the template the fabric 24 is held tautly in the hoop parallel to the plane of the panel so that it can be embroidered or otherwise sewn when it is disposed under the head of an embroidery machine, as will be described later.

As can be seen in FIG. 1 a pair of straps 36A and 36B are mounted on the top surface of the panel 26 adjacent respective openings 28A and 28B. Each strap is an elongated elastic member which is disposed linearly and perpendicular to the axis 30. Each strap is secured to the panel at its two ends, by means of staples 38. The straps serve as a means for holding down the fabric or material of the garment being embroidered and which is located outside of the hoop, so that such fabric or material does not interfere with the embroidery operation.

The template 20 is arranged to be disposed on the platform or table 40 of a single or multihead embroidering machine 42. In the embodiment shown herein the machine 42 is a multihead machine, that is, it has a plurality of working or embroidery heads 44, all mounted on a common beam 46 extending across the platform 40. Each head 44 includes plural needles (not shown) for effecting the embroidery of the fabric portion 24 held within a hoop in the template 20 located therebelow.

Figure 3:
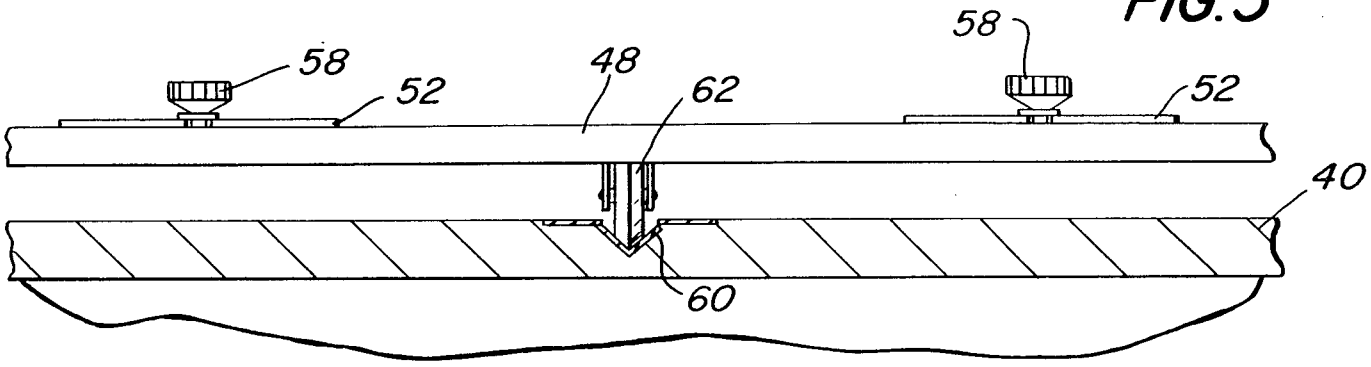
FIG. 3 is an enlarged sectional view taken along line 3—3 of FIG. 2.

When the template 20 is to used with a multihead machine 42 plural templates 20 are used, one for each head. Thus, the templates are disposed immediately adjacent to one another and are held in position by an encircling frame 48 (See FIGS. 2 and 3). Thus, the frame 48 is a generally rectangular planar member having a central opening 50 in which the templates 20 are located. Each template is secured in place in the frame via a pair of hold down plates 52 mounted on the template along axis 30. As can be seen each hold down plate is a generally flat member extending beyond the end of the template panel 26 and is secured in place via plural screws 54. A slot 56 is provided in the end of each hold down plate along axis 30. The slot is arranged to receive a threaded screw 58 (FIG. 3) to secure the hold down plate onto the frame 48 as shown in FIG. 3.

With the templates 20 being located within frame 48 as shown in FIG. 2 the frame 48 is arranged to be moved from the full line position shown therein (wherein those hoops 22 holding fabric disposed within template openings 28A are located under the plural heads 44 of the machine 42) to the phantom line position shown therein. In the phantom line position the material held within the hoops 22 located within openings 28B are located under the machine's embroidery heads 44. Thus, when the templates are in the full line position as shown in FIG. 2 embroidery of the materials held within the openings 28A can be effected while the openings 28B can be loaded with hoops 22 holding material ready for embroidery. After the embroidery of the material held within openings 28A is effected the frame is slid across the table for platform 40 to the phantom line position so that embroidery of the material held within hoops 22 in the openings 28B can be effected, while the previously embroidered material in hoops 22 located in openings 28A is removed.

In order to facilitate the movement of the frame from the solid line position to the phantom line position, and vice versa, platform 40 may be provided with plural tracks 60 (only one of which is shown) extending thereacross. When such tracks are used the frame 48 includes plural wheels or rollers 62 mounted on the underside thereof to roll along the track. The frame 40 can be moved along the track either manually or by mechanical means, such as a motor, not shown.

It must be pointed out at this juncture that the dimensions given heretofore are merely exemplary and are, of course, a function of the size of the embroidery machine, the spacing between its heads, etc. So too, the materials making up the panel of the template can be selected to be any suitable materials, such as wood, plastic, metal.

As will be appreciated from the foregoing the double hoop template 20 of the subject invention is suitable for holding an entire garment to be embroidered and to permit the embroidery machine to work on garments set in one hoop while operators are taking out a finished garment or putting in new garments in the other hoop. Such operation dramatically increases operating efficiency of the machine.

Without further elaboration, the foregoing will so fully illustrate my invention that others may, by applying current or future knowledge, readily adopt the same for use under various conditions of service.

I claim:

1. A template for use with an embroidery machine for embroidering material held within an embroidery hoop, said machine including a working head and a platform located thereunder, said template being arranged for disposition on said platform to hold a pair of embrodiery hoops beside each other so that a first one of said hoops can be located under said working head while the second one of said hoops is located laterally thereof, whereupon said working head can embroidery material held within said first hoop while the second hoop can be unloaded or loaded with said material, said templat including a portion arranged to be engaged to move said template across said platform so that said second hoop can be located under said working head, while said first hoop is located laterally thereof, said template comprising a generally planar panel having a pair of aligned openings therein, each of said openings being configured to releasably secure an embroidery hoop with material to be embroidered therein.

2. The template of claim 1 wherein said template is arranged to be moved across said platform by frame means, and wherein said portion of said template includes securement means for releasably securing it to said frame means.

3. The template of claim 2 wherein said securement means comprises a pair of hold-down plates.

4. The template of claim 3 wherein each of said template openings is circular and includes a cut-out recess having resilient means located therein.

5. The template of claim 1 additionally comprising means for holding a portion of said material which extends out of said hoop onto said template.

6. The template of claim 5 wherein said holding means comprises a strap.

7. The template of claim 6 wherein said strap is elastic.

8. The template of claim 1 wherein said template is arranged to be disposed adjacent other similar templates on said platform for use with an embroidery machine having plural working heads located thereover, said templates being held together next to one another by frame means so that corresponding ones of said openings in each of said templates is located under a respective working head of said embrodiery machine while the other of said openings in each of said templates is located laterally thereof for loading or unloading of its hoop.

9. The templates of claim 8 wherein said portion of each template comprises securement means for releasably securing it to said frame.

10. The templates of claim 9 wherein each of said securement means comprises a pair of hold-down plates.

11. The templates of claim 10 wherein each of template openings is circular and includes a cut-out recess having resilient means located therein.

12. The templates of claim 11 additionally comprising means for holding a portion of said material which extends out of said hoop onto said template.

13. The templates of claim 12 wherein said holding means comprises a strap.

14. The templates of claim 13 wherein said strap is elastic.

15. The templates of claim 14 wherein said panel is generally rectangular in shape with its two openings each being approximately 5" (12.7 cm) in diameter and spaced along a first axis by approximately 11¾"(29.8 cm) between the centers of said openings, said elastic straps being elongated members extending perpendicularly to said axis and located adjacent respective openings on said panel between said openings.

* * * * *